US012303029B2

(12) United States Patent
Luo et al.

(10) Patent No.: US 12,303,029 B2
(45) Date of Patent: May 20, 2025

(54) BUFFERING REBOUND SYNCHRONIZATION DEVICE

(71) Applicant: GUANGDONG SACA PRECISION MANUFACTURING CO., LTD., Foshan (CN)

(72) Inventors: Yonghong Luo, Foshan (CN); Gengxi Cai, Foshan (CN); Kaicheng Lun, Foshan (CN); Jiaxin Wang, Foshan (CN)

(73) Assignee: GUANGDONG SACA PRECISION MANUFACTURING CO., LTD., Guangdong (CN)

( * ) Notice: Subject to any disclaimer, the term of this patent is extended or adjusted under 35 U.S.C. 154(b) by 0 days.

(21) Appl. No.: 18/911,741

(22) Filed: Oct. 10, 2024

(65) Prior Publication Data

US 2025/0031847 A1 Jan. 30, 2025

Related U.S. Application Data

(63) Continuation of application No. PCT/CN2023/088054, filed on Apr. 13, 2023.

(51) Int. Cl.
*A47B 88/463* (2017.01)

(52) U.S. Cl.
CPC ..... *A47B 88/463* (2017.01)

(58) Field of Classification Search
CPC ..... A47B 88/463
See application file for complete search history.

(56) References Cited

U.S. PATENT DOCUMENTS

| | | | | |
|---|---|---|---|---|
| 8,899,703 | B2 * | 12/2014 | Chung | A47B 88/463 312/334.8 |
| 9,532,648 | B2 * | 1/2017 | Gasser | A47B 88/437 |
| 9,622,578 | B2 * | 4/2017 | Goetz | A47B 88/47 |
| 9,642,461 | B2 * | 5/2017 | Goetz | A47B 88/463 |
| 9,756,940 | B2 * | 9/2017 | Chen | A47B 88/467 |
| 10,070,721 | B2 * | 9/2018 | Brunnmayr | A47B 88/47 |

(Continued)

FOREIGN PATENT DOCUMENTS

| | | | | |
|---|---|---|---|---|
| AT | 514141 | B1 * | 8/2015 | A47B 88/463 |
| AT | 516733 | B1 * | 8/2016 | A47B 88/447 |

(Continued)

*Primary Examiner* — Hanh V Tran
(74) *Attorney, Agent, or Firm* — Ming Jiang; OPENPTO US LLC

(57) ABSTRACT

A bottom rail buffer rebound synchronization device, including rebound components, and a synchronous linkage assembly provided between the rebound components. The rebound components include a fixed plate assembly, a toggle block assembly slidably provided on the fixed plate assembly, an elastic sliding assembly, and a synchronous sliding assembly. The elastic sliding assembly is provided with an elastic stopper that can be extended and retracted. The fixed plate assembly is provided with an orienteering protrusion, which forms a backward guide groove, a separation guide groove, a clamping groove position, a forward guide groove, and a reset guide groove with the fixed plate assembly. The elastic sliding assembly is slid in the backward guide groove, the separation guide groove, the clamping groove position, the forward guide groove, and the reset guide groove in a cycle manner.

9 Claims, 10 Drawing Sheets

(56) References Cited

U.S. PATENT DOCUMENTS

| | | | | |
|---|---|---|---|---|
| 10,405,653 | B2 * | 9/2019 | Goetz | A47B 88/463 |
| 2017/0086583 | A1 | 3/2017 | Chen | |
| 2018/0317653 | A1 | 11/2018 | Xu | |
| 2020/0190882 | A1 * | 6/2020 | Bantle | E05F 3/00 |
| 2022/0000264 | A1 | 1/2022 | Janser | |

FOREIGN PATENT DOCUMENTS

| | | | | | |
|---|---|---|---|---|---|
| AT | 15245 | U1 * | 2/2017 | | A47B 88/463 |
| AT | 515040 | B1 * | 12/2017 | | A47B 88/40 |
| AT | 514865 | B1 * | 3/2018 | | A47B 88/463 |
| CN | 105433618 | A * | 3/2016 | | |
| CN | 110353423 | A | 10/2019 | | |
| CN | 110477646 | B | 11/2019 | | |
| CN | 110537795 | A * | 12/2019 | | |
| CN | 211673252 | U | 10/2020 | | |
| CN | 215650042 | U * | 1/2022 | | |
| CN | 114009976 | A | 2/2022 | | |
| CN | 215820268 | U * | 2/2022 | | |
| CN | 114557560 | A * | 5/2022 | | |
| CN | 216797011 | U * | 6/2022 | | |
| CN | 217137253 | U | 8/2022 | | |
| DE | 202015104431 | U1 * | 12/2016 | | A47B 88/463 |
| DE | 102015117004 | B3 * | 3/2017 | | A47B 88/463 |
| WO | WO-2014165873 | A1 * | 10/2014 | | A47B 88/463 |
| WO | WO-2015051386 | A2 * | 4/2015 | | A47B 88/463 |

* cited by examiner

BUFFERING REBOUND SYNCHRONIZATION DEVICE

CROSS-REFERENCE TO RELATED APPLICATIONS

This application is a continuation of International Application No. PCT/CN2023/088054, filed on Apr. 13, 2023, which claims priority to Chinese Patent Application No. 202220857091.0, filed on Apr. 13, 2022, both of which are hereby incorporated by reference in their entireties.

TECHNICAL FIELD

The present application relates to the field of buffering rebound device technologies, and in particular, to a bottom rail buffer rebound synchronization device.

BACKGROUND

The commonly used functional accessories for a bottom rail include a pressing rebound device, which stores energy when the bottom rail is closed and leaves a space for unlocking by pressing. By pressing a drawer, the drawer and other pull-out furniture can be unlocked and rebound, thereby achieving an automatic opening of the pull-out furniture. It is very convenient to use and improves a use safety.

However, the pressing rebound device in related technologies has the following shortcomings in practical applications:

1) a structure of the pressing rebound device is complex, and a force required to eject during pressing and rebounding is insufficient, which results in a limited distance for the drawer to be ejected;
2) the rebound device produces a significant movement noise during use, which affects a user experience of the product.

SUMMARY

The present application provides a bottom rail buffer rebound synchronization device with high structural stability and being capable of reducing a frictional pressure during operation, rending a drawer to be smoothly ejected, with greater ejection tension and better ejection distance, thereby enhancing a user experience of a product.

An embodiment of the present application provides a bottom rail buffer rebound synchronization device, including rebound components provided on left and right sides of a drawer and configured to be buckled or separated with a slide rail when the drawer is opened and closed; a synchronous linkage assembly configured for a synchronous operation is provided between the rebound components; where the rebound components include a fixed plate assembly, a toggle block assembly slidably provided on the fixed plate assembly, an elastic sliding assembly, and a synchronous sliding assembly; two ends of the synchronous linkage assembly are respectively provided with the synchronous sliding assembly for installation; the synchronous sliding assembly is pushed by the elastic sliding assembly to move backward or forward when the drawer is opened and closed; the elastic sliding assembly is provided with an elastic stopper, the fixed plate assembly is provided with an orienteering protrusion; a backward guide groove configured for the elastic stopper to be slid backwards in a straight line under a push of the elastic sliding assembly, a separation guide groove configured for compressing the elastic stopper to be separated from the toggle block assembly, a clamping groove position configured for buckling with the elastic stopper, a forward guide groove configured for the elastic stopper to be slid forwards in a straight line under a pull of the elastic sliding assembly in a compressed state, and a reset guide groove configured for the elastic stopper to be reset, ejected, and connected with the toggle block assembly are formed by the orienteering protrusion with the fixed plate assembly; the elastic sliding assembly is slid in the backward guide groove, the separation guide groove, the clamping groove position, the forward guide groove, and the reset guide groove when the drawer is opened and closed in a cycle manner.

In one embodiment, the fixed plate assembly includes a fixed plate fixed between the drawer and the slide rail, a positioning bottom plate provided on the fixed plate, the orienteering protrusion is integrally formed on the positioning bottom plate; the backward guide groove and the forward guide groove are respectively provided on left and right sides of the orienteering protrusion; the separation guide groove and the clamping groove position are respectively provided at a rear end of the orienteering protrusion; the reset guide groove is provided at a front end of the orienteering protrusion.

In one embodiment, the positioning bottom plate is provided with a guide groove configured for the toggle block assembly to be sild forward and backward, and a front end of the guide groove is provided with a corner groove configured for a turning of the toggle block assembly and being buckled with a movable rail of the slide rail.

In one embodiment, the positioning bottom plate is provided with an inclined protrusion configured for the elastic stopper to be slid into the separation guide groove and offset with the toggle block assembly for separation, the inclined protrusion is gradually tilted to right and upward on the positioning bottom plate from the separation guide groove.

In one embodiment, the elastic sliding assembly includes a sliding block, a sliding push rod, and a spring, the sliding block is slid forward and backward on the positioning bottom plate, one side of the spring is fastened to the sliding block, the other side of the spring is fastened to the positioning bottom plate, a positioning end shaft of the sliding push rod is connected to the sliding block, the elastic stopper is elastically extended, contracted and connected to the sliding block.

In one embodiment, the sliding block is provided with a push rod configured for pushing the synchronous sliding assembly to be slid backward when the toggle block assembly is moved backward.

In one embodiment, a rear end of the positioning bottom plate is provided with a transmission groove for causing the sliding push rod to slide backward in a directional manner with the sliding block and pushing the synchronous sliding assembly to be moved forward when pressing the toggle block assembly.

In one embodiment, the positioning bottom plate is provided with a linear guide groove configured for the sliding block to be slid forward and backward in a straight line.

In one embodiment, the fixed plate is provided with an adjustment knob configured for adjusting an installation position of the positioning bottom plate; one end of the adjustment knob is connected to the positioning bottom plate, and the other end of the adjustment knob is connected to the fixed plate by a screw.

In one embodiment, the toggle block assembly is a toggle component with a straight side edge, and the sliding block is connected or separated from the straight side edge of the toggle component when the drawer is opened and closed.

DESCRIPTION OF EMBODIMENTS

Figure 1:
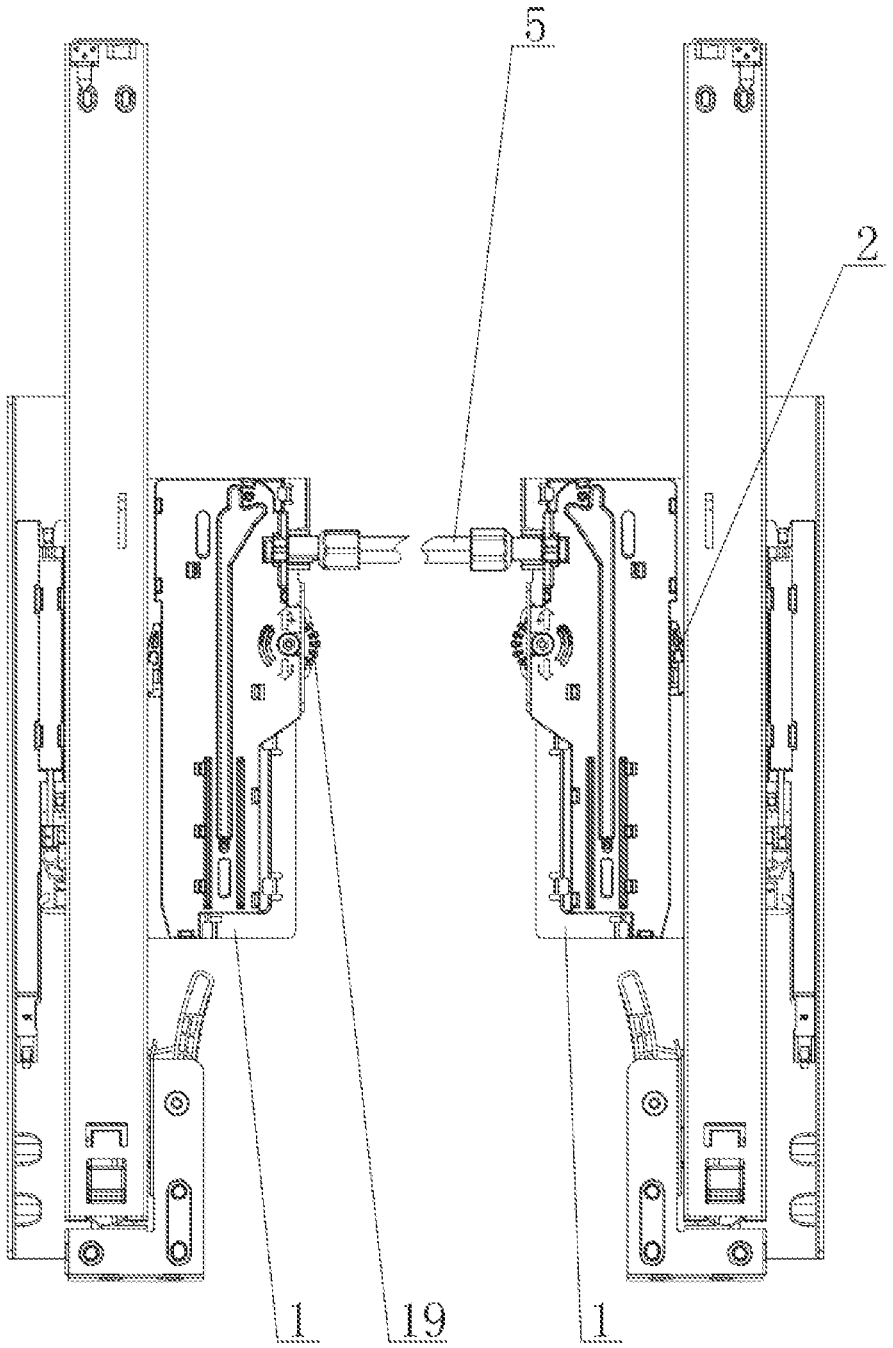
FIG. 1 is an assembly schematic diagram of a bottom rail buffer rebound synchronization device provided in an embodiment of the present application.
Figure 2:
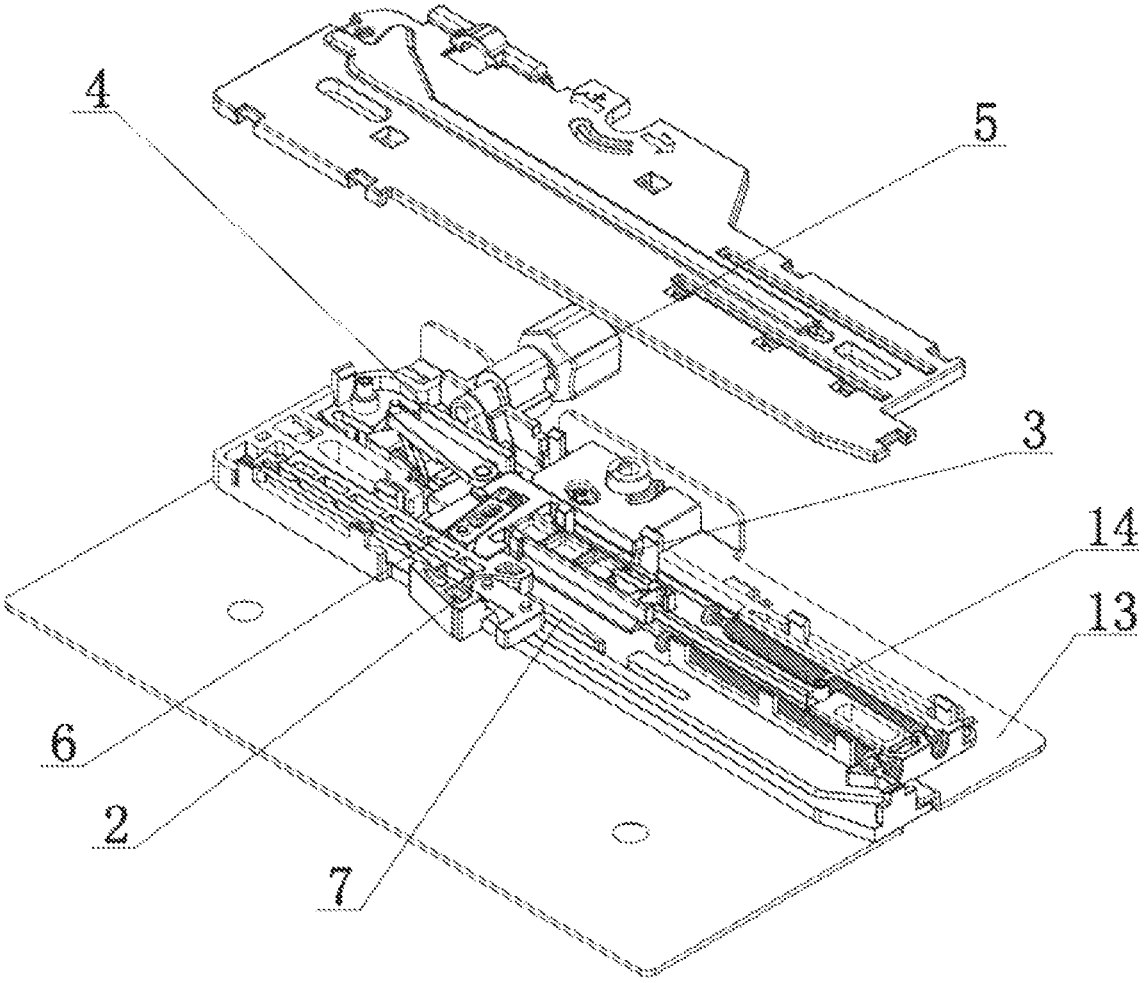
FIG. 2 is a schematic structural diagram of the bottom rail buffer rebound synchronization device provided in an embodiment of the present application.
Figure 3:
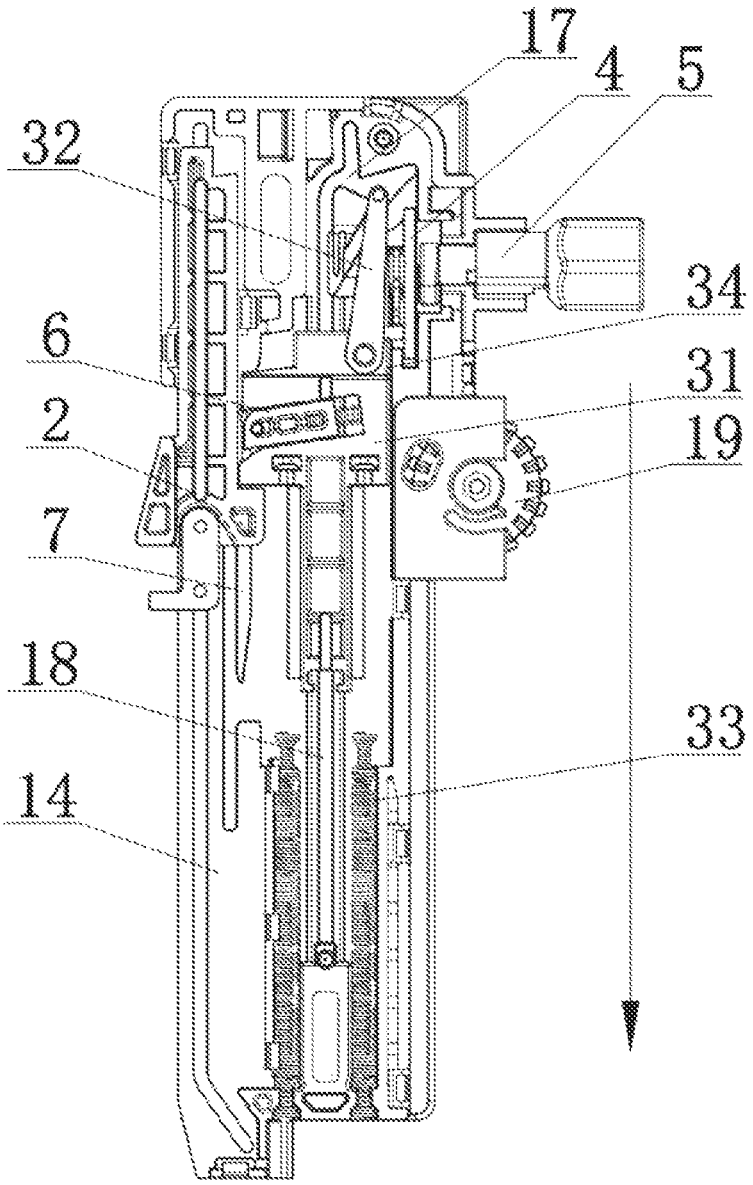
FIGS. 3 and 4 are schematic structural diagrams of the bottom rail buffer rebound synchronization device in a closed state provided in an embodiment of the present application.
Figure 4:
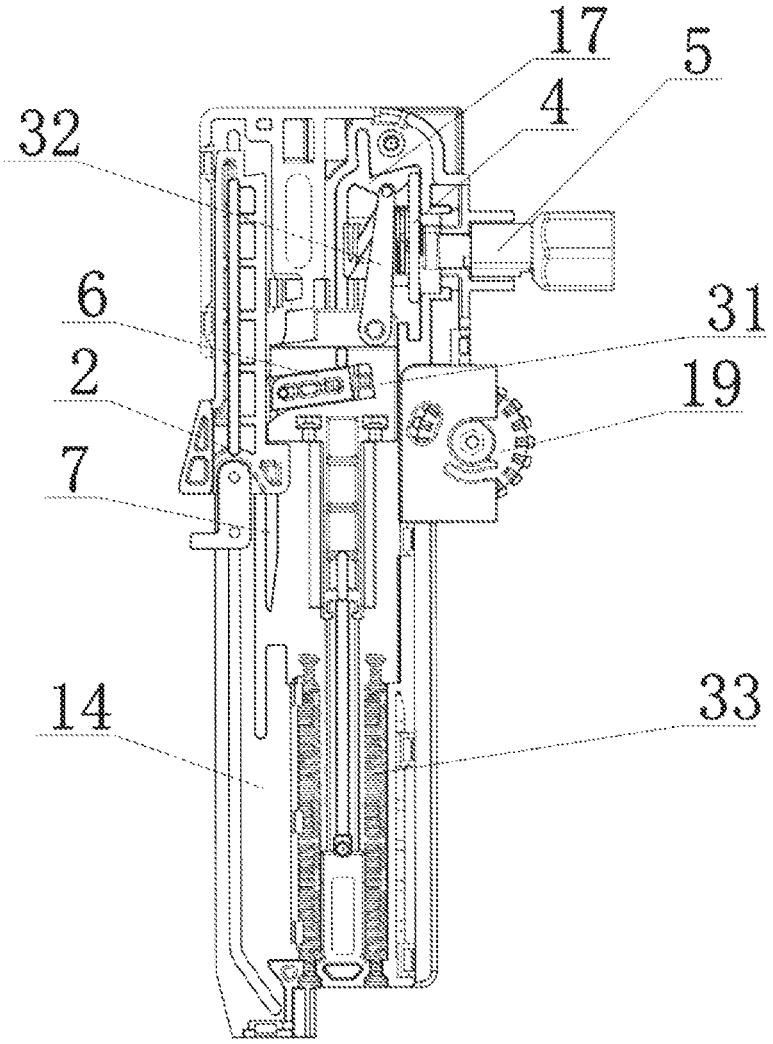
Figure 5:
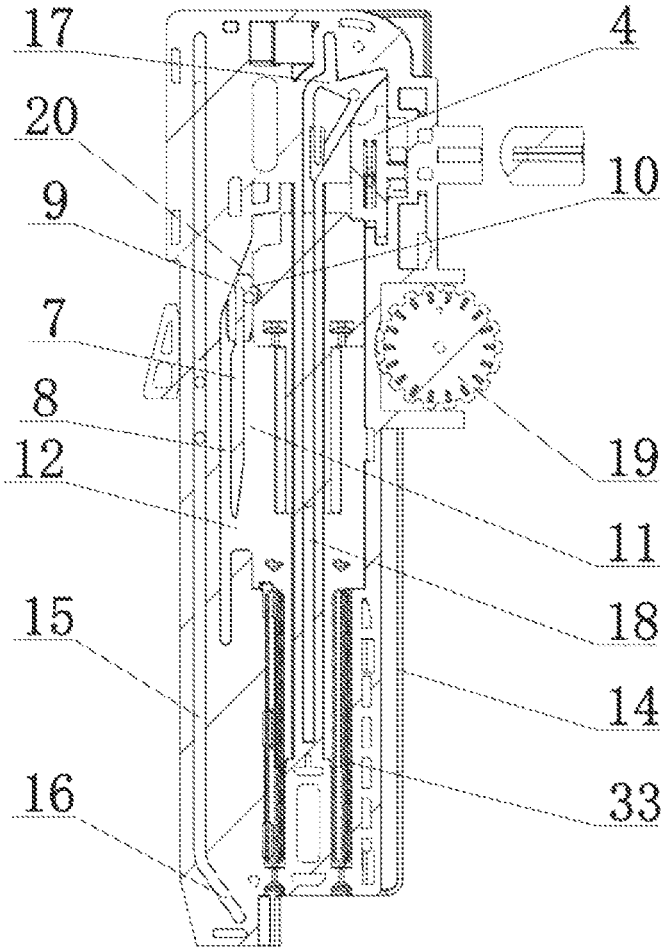
FIGS. 5 and 6 are sectional views of the bottom rail buffer rebound synchronization device in the closed state provided by an embodiment of the present application.
Figure 6:
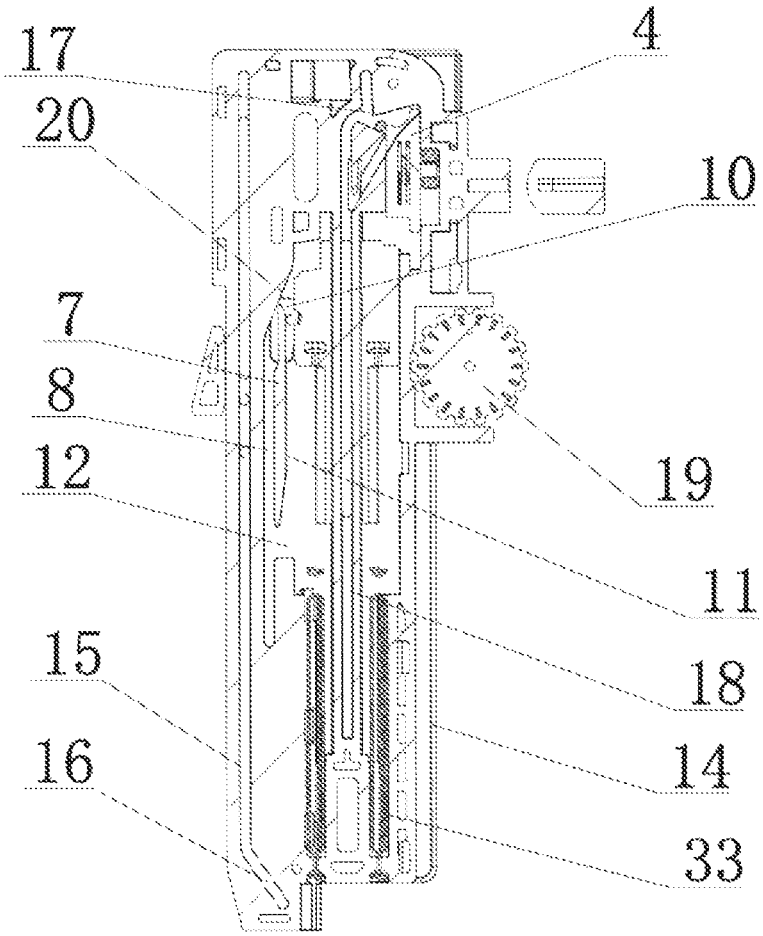
Figure 7:
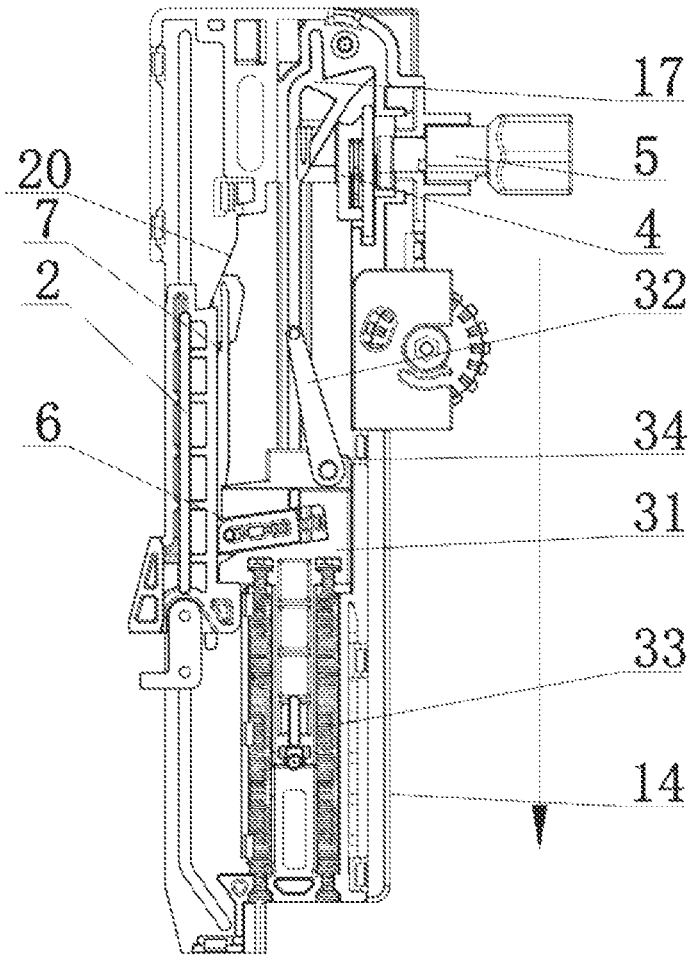
FIG. 7 is a schematic structural diagram of the bottom rail buffer rebound synchronization device in an open state provided in an embodiment of the present application.
Figure 8:
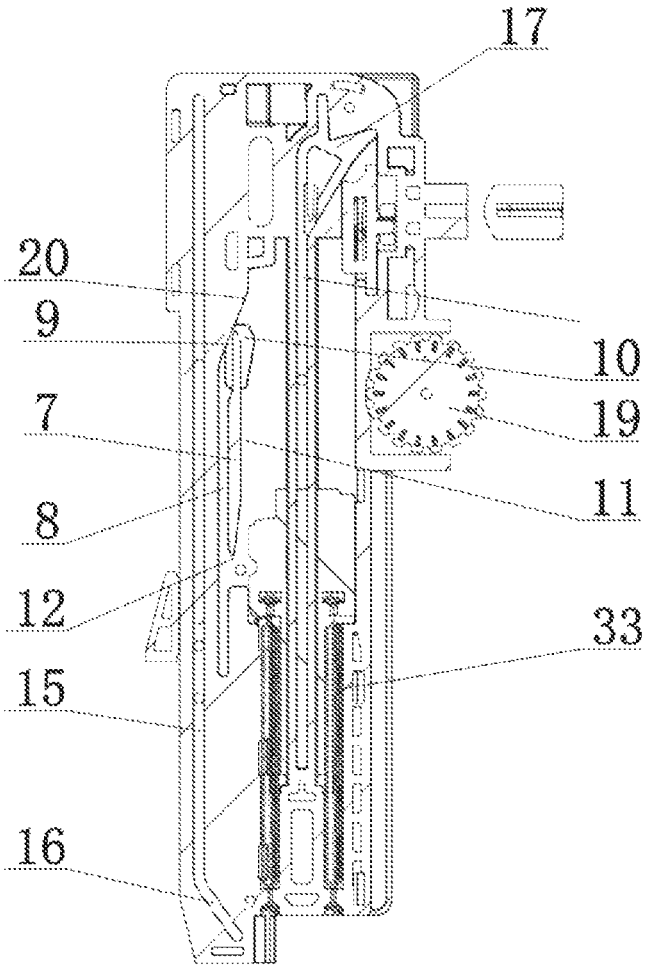
FIG. 8 is a sectional view of the bottom rail buffer rebound synchronization device in the open state provided by an embodiment of the present application.

According to FIGS. 1 to 8, a bottom rail buffer rebound synchronization device of the present application includes rebound components provided on left and right sides of a drawer and connected or separated with a slide rail as the drawer is opened and closed. A synchronous linkage assembly 5 configured for a synchronous operation is provided between the rebound components. Where the rebound components include a fixed plate assembly 1, a toggle block assembly 2 slidably provided on the fixed plate assembly 1, an elastic sliding assembly 3, and a synchronous sliding assembly 4. Two ends of the synchronous linkage assembly 5 are respectively matched with the synchronous sliding assembly 4 for installation, and the synchronous sliding assembly 4 is pushed by the elastic sliding assembly 3 to move backward or forward as the drawer is opened and closed. The elastic sliding assembly 3 is provided with an elastic stopper 6 that can be stretched out and drawn back. The fixed plate assembly 1 is provided with an orienteering protrusion 7. The orienteering protrusion 7 and the fixed plate assembly 1 form a backward guide groove 8 configured for the elastic stopper 6 to be slid back in a straight line under a push of the elastic sliding assembly 3, a separation guide groove 9 configured for compressing the elastic stopper 6 to be separated from the toggle block assembly 2, a clamping groove position 10 configured for buckling with the elastic stopper 6, a forward guide groove 11 configured for the elastic stopper 6 to be slid forward in a straight line under a pull of the elastic sliding assembly 3 in a compressed state, and a reset guide groove 12 configured for the elastic stopper 6 to be reset, popped out, and connect with the toggle block assembly 2. The elastic sliding assembly 3 is slid in the backward guide groove 8, the separation guide groove 9, the clamping groove position 10, the forward guide slot 11, and reset guide groove 12 as the drawer is opened and closed in a cyclic manner.

Figure 9:
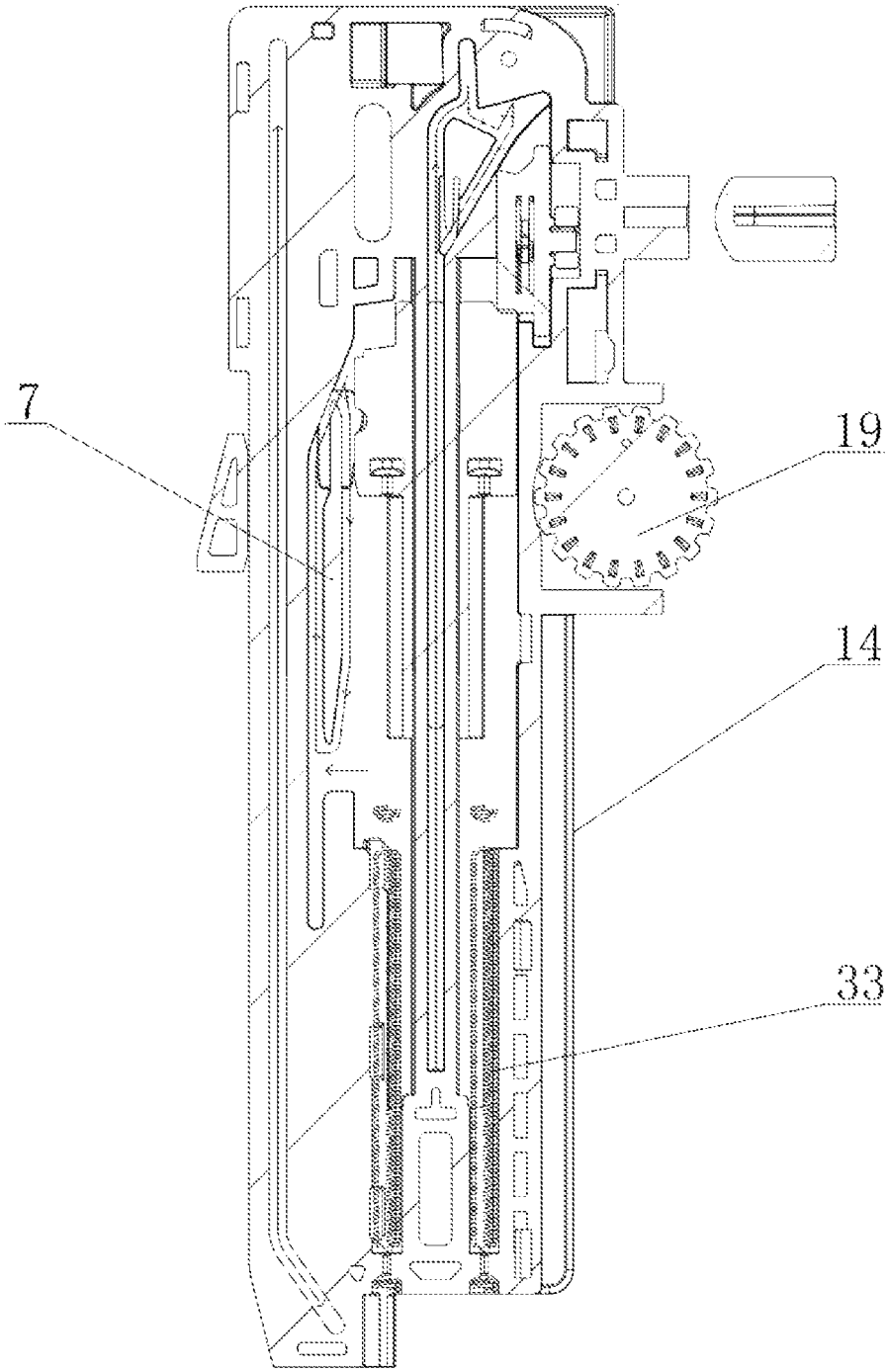
FIG. 9 is a schematic diagram showing a motion trajectory of the bottom rail buffer rebound synchronization device provided by an embodiment of the present application.
Figure 10:
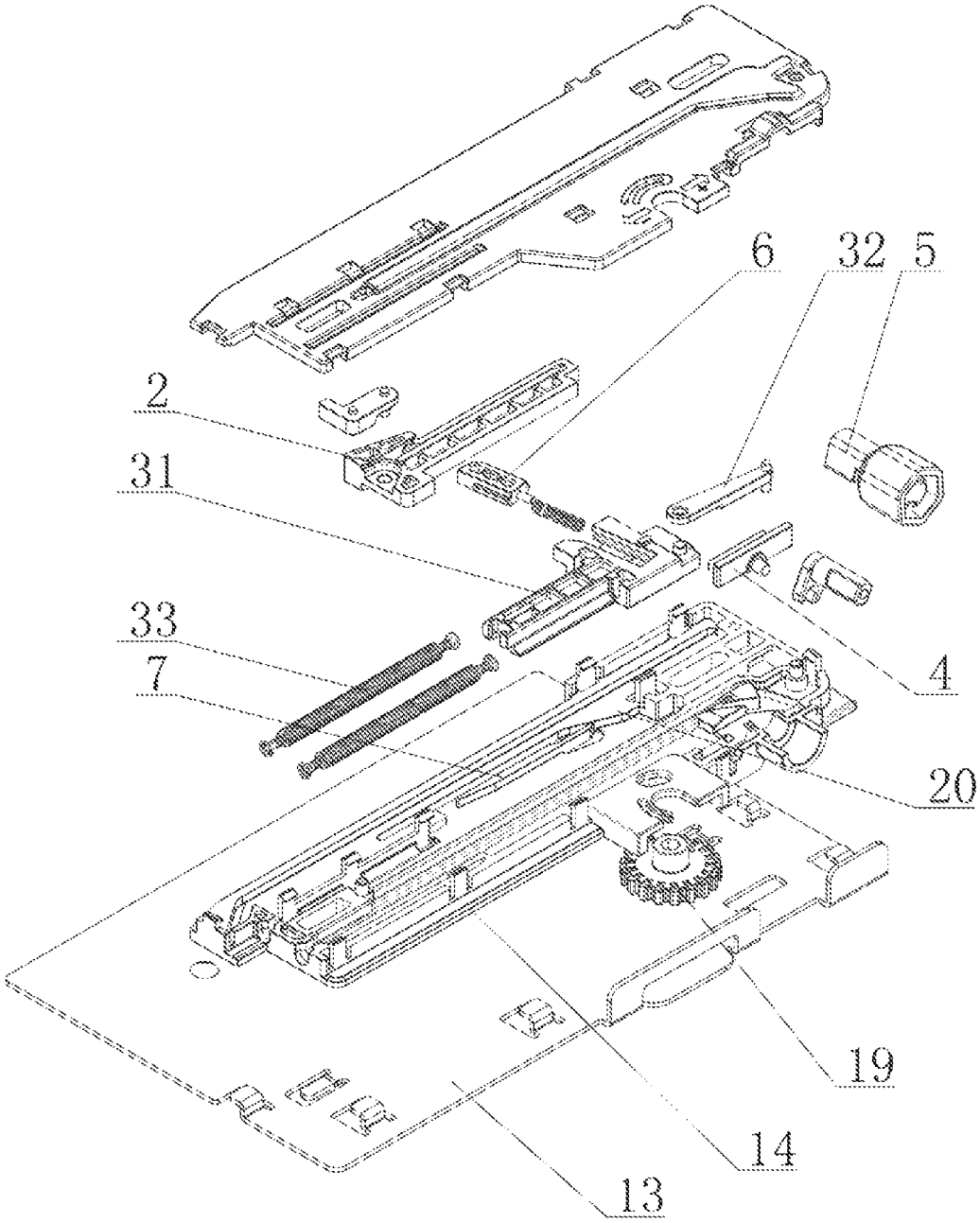
FIG. 10 is an exploded view of the bottom rail buffer rebound synchronization device provided by an embodiment of the present application.

Referring to FIGS. 1 to 10, in an embodiment, the fixed plate assembly 1 includes a fixed plate 13 fixed between the drawer and the slide rail, a positioning bottom plate 14 provided on the fixed plate 13. The orientation protrusion 7 is integrally formed on the positioning bottom plate 14. The backward guide groove 8 and the forward guide groove 11 are respectively provided on left and right sides of the orientation protrusion 7; the separation guide groove 9 and the clamping groove position 10 are respectively provided at a rear end of the orientation protrusion 7, and the reset guide groove 12 is provided at a front end of the orientation protrusion 7.

In an implementation mode, the positioning bottom plate 14 is provided with a guide groove 15 configured for forward and backward sliding of the toggle block assembly 2, and a front end of the guide groove 15 is provided with a corner groove 16 configured for a turning of the toggle block assembly 2 and being buckled with a movable rail of the slide rail.

In an implementation mode, the positioning bottom plate 14 is provided with an inclined protrusion 20 that allows the elastic stopper 6 to be slid into the separation guide groove 9 and be offset from the toggle block assembly 2 for separation. The inclined protrusion 20 is gradually tilted to right and upward on the positioning bottom plate 14 from the separation guide groove 9.

In a practical application, the elastic sliding assembly 3 includes a sliding block 31, a sliding push rod 32, and a spring 33. The sliding block 31 is slid forward and backward on the positioning bottom plate 14. One side of the spring 33 is fastened to the sliding block 31, and the other side of the spring 33 is fastened to the positioning bottom plate 14. A positioning end shaft of the sliding push rod 32 is connected to the sliding block 31, and the elastic stopper 6 is elastically extended and contracted and connected to the sliding block 31.

The sliding block 31 is provided with a push rod 34 configured for pushing the synchronous sliding assembly 4 to be slid backward as the toggle block assembly 2 is moved backward. A rear end of the positioning bottom plate 14 is provided with a transmission groove 17 configured for the sliding push rod 32 to be slid backwards in a directional manner with the sliding block 31, and pushing the synchronous sliding assembly 4 to be moved forward when pressing the toggle block assembly.

In an embodiment, in order to operate stability, the positioning bottom plate 14 is provided with a linear guide groove 18 configured for the sliding block 31 to be slid forward and backward in a straight line.

That is, when the drawer is pushed to close, it touches the toggle block assembly 2, and the toggle block assembly 2 is slid along the corner groove 16 to the guide groove 15, so that the toggle block assembly 2 is fastened on the movable rail of the slide rail. Then, the toggle block assembly 2 is moved backward along the guide groove 15 with the drawer, and at the same time, the sliding block 31 is slid backward along the positioning bottom plate 14 to drive a compressed elastic stopper 6 to move backward in a straight line along the backward guide groove 8. During this period, the sliding push rod 32 is slid on the transmission groove 17 along with the sliding block 31, and the push rod 34 also pushes the synchronous sliding assembly 4 to be slid backward under a driving of the sliding rod, thereby achieving synchronous closure of the rebound components on both sides.

When the elastic stopper 6 is pushed by the inclined protrusion 20, the elastic stopper 6 is pushed along an inclined edge of the inclined protrusion 20 to the separation guide groove 9, and thus separated from the toggle block assembly 2, and achieving a free movement of the toggle block assembly 2 and closing the drawer. At this time, under an action of a reset elastic force of the spring 33, the sliding block 31 is pulled to rebound forward, the elastic stopper 6 is caused to be clamped on the clamping groove position 10 along the orienteering protrusion 7, and the sliding push rod 32 is caused to be retracted on the synchronous sliding assembly 4, thereby the rebound components on the left and right sides respectively achieve a rebound limit state.

When the drawer is pressed to open, the sliding block 31 is moved forward along the guide groove 15 under a restoring elastic force of the spring 33, so that the elastic stopper 6 is separated from the clamping groove position 10 and slid forward in a straight line along the forward guide groove 11 of the positioning protrusion. At this time, the sliding block 31 is connected to the toggle block assembly 2 and drives the toggle block assembly 2 to be quickly popped forward. At the same time, the sliding push rod 32 pushes the synchronous sliding assembly 4 to move forward under the action of elastic force, and drives the synchronous linkage assembly 5 to rotate, so as to achieve synchronous unlocking and popping of the rebound components on both sides.

When the elastic stopper 6 is slid into the reset guide groove 12 from the forward guide groove 11, it is horizontally moved back to the backward guide groove 8 through the reset guide groove 12, thereby achieving a complete ejection of the rebound component and entering a next closure of the drawer.

In this way, by utilizing a structural cooperation of the backward guide groove 8, the separation guide groove 9, the clamping groove position 10, the forward guide groove 11, and the reset guide groove 12, a movement trajectory of the elastic stopper 6 can be changed to reduce a frictional pressure, and the rebound synchronization device of this structure can have more rebound force during rebound, smoother ejection, longer drawer ejection distance, and enhance the user experience of the product.

Referring to FIGS. 1 to 10, in an embodiment, the toggle block assembly 2 is an A-type toggle component with a straight side edge, and the sliding block 31 is connected or separated from the straight side edge of the A-type toggle component when the drawer is opened and closed. Which simplifies the structure of the toggle block assembly 2, effectively improves a stability of the toggle block assembly 2 during operation, and reduces a frictional pressure, rendering it smoother for the rebound component to be popped out.

In an implementation mode, the fixed plate 13 is provided with an adjustment knob 19 for adjusting an installation position of the positioning bottom plate 14. One end of the adjustment knob 19 is connected to the positioning bottom plate 14, and the other end of the adjustment knob 19 is connected to the fixed plate 13 with a screw.

When assembling, the adjustment knob 19 is only needed to adjust the positioning bottom plate 14 to move forward or backward, thereby adjusting an assembly position of the rebound component, thereby improving an accuracy of the use of the rebound components, ensuring operational stability, and ensuring product quality.

What is claimed is:

1. A bottom rail buffer rebound synchronization device, comprising rebound components provided on left and right sides of a drawer and configured to be buckled or separated with a slide rail when the drawer is opened and closed;

a synchronous linkage assembly configured for a synchronous operation is provided between the rebound components;

wherein the rebound components include a fixed plate assembly, a toggle block assembly slidably provided on the fixed plate assembly, an elastic sliding assembly, and a synchronous sliding assembly;

two ends of the synchronous linkage assembly are respectively provided with the synchronous sliding assembly for installation;

the synchronous sliding assembly is pushed by the elastic sliding assembly to move backward or forward when the drawer is opened and closed;

the elastic sliding assembly is provided with an elastic stopper, the fixed plate assembly is provided with an orienteering protrusion, a fixed plate fixed between the drawer and the slide rail, and a positioning bottom plate provided on the fixed plate, a backward guide groove configured for the elastic stopper to be slid backwards in a straight line under a push of the elastic sliding assembly, a separation guide groove configured for compressing the elastic stopper to be separated from the toggle block assembly, a clamping groove position configured for buckling with the elastic stopper, a forward guide groove configured for the elastic stopper to be slid forwards in a straight line under a pull of the elastic sliding assembly in a compressed state, and a reset guide groove configured for the elastic stopper to be reset, ejected and connected with the toggle block assembly are formed by the orienteering protrusion with the fixed plate assembly;

the elastic sliding assembly is slid in the backward guide groove, the separation guide groove, the clamping groove position, the forward guide groove, and the reset guide groove when the drawer is opened and closed in a cycle manner;

wherein the elastic sliding assembly comprises a sliding block, a sliding push rod, and a spring, the sliding block is slid forward and backward on the positioning bottom plate, one side of the spring is fastened to the sliding block, the other side of the spring is fastened to the positioning bottom plate, a positioning end shaft of the sliding push rod is connected to the sliding block, the elastic stopper is elastically extended, contracted and connected to the sliding block.

2. The bottom rail buffer rebound synchronization device according to claim 1, wherein the orienteering protrusion is integrally formed on the positioning bottom plate;

the backward guide groove and the forward guide groove are respectively provided on left and right sides of the orienteering protrusion;

the separation guide groove and the clamping groove position are respectively provided at a rear end of the orienteering protrusion;

the reset guide groove is provided at a front end of the orienteering protrusion.

3. The bottom rail buffer rebound synchronization device according to claim 2, wherein the positioning bottom plate is provided with a guide groove configured for the toggle block assembly to be slid forward and backward, and a front end of the guide groove is provided with a corner groove configured for a turning of the toggle block assembly and being buckled with a movable rail of the slide rail.

4. The bottom rail buffer rebound synchronization device according to claim 2, wherein the positioning bottom plate is provided with an inclined protrusion configured for the elastic stopper to be slid into the separation guide groove and offset with the toggle block assembly for separation, the inclined protrusion is gradually tilted to right and upward on the positioning bottom plate from the separation guide groove.

5. The bottom rail buffer rebound synchronization device according to claim 1, wherein the sliding block is provided with a push rod configured for pushing the synchronous sliding assembly to be slid backward when the toggle block assembly is moved backward.

6. The bottom rail buffer rebound synchronization device according to claim 1, wherein a rear end of the positioning bottom plate is provided with a transmission groove for causing the sliding push rod to slide backward in a directional manner with the sliding block and pushing the synchronous sliding assembly to be moved forward when pressing the toggle block assembly.

7. The bottom rail buffer rebound synchronization device according to claim 6, wherein the positioning bottom plate is provided with a linear guide groove configured for the sliding block to be slid forward and backward in a straight line.

8. The bottom rail buffer rebound synchronization device according to claim 1, wherein the fixed plate is provided with an adjustment knob configured for adjusting an installation position of the positioning bottom plate, one end of the adjustment knob is connected to the positioning bottom plate, and the other end of the adjustment knob is connected to the fixed plate by a screw.

9. The bottom rail buffer rebound synchronization device according to claim 1, wherein the toggle block assembly is a toggle component with a straight side edge.

* * * * *